United States Patent [19]

Cooper et al.

[11] Patent Number: 4,544,143

[45] Date of Patent: Oct. 1, 1985

[54] TAPHOLE PLUGGING APPARATUS FOR A SHAFT FURNACE

[75] Inventors: Arthur Cooper, Burlington, Canada; Pierre Mailliet, Howald, Luxembourg

[73] Assignee: Paul Wurth, S.A., Luxembourg

[21] Appl. No.: 602,510

[22] Filed: Apr. 20, 1984

[30] Foreign Application Priority Data

Apr. 21, 1983 [LU] Luxembourg ..... 84764

[51] Int. Cl.[4] ..... C21B 7/12

[52] U.S. Cl. ..... 266/273; 266/271

[58] Field of Search ..... 266/273, 271, 272

[56] References Cited

U.S. PATENT DOCUMENTS

| | | | |
|---|---|---|---|
| 3,709,477 | 1/1977 | Baumer et al. | 266/273 |
| 3,765,663 | 10/1973 | Legille et al. | 266/273 |
| 4,195,825 | 4/1980 | Ulveling et al. | 266/271 |
| 4,220,321 | 9/1980 | Brücher | 266/271 |
| 4,227,682 | 10/1980 | Ulveling et al. | 266/271 |
| 4,247,088 | 1/1981 | Ueno et al. | 266/273 |

*Primary Examiner*—L. Dewayne Rutledge
*Assistant Examiner*—S. Kastler
*Attorney, Agent, or Firm*—Fishman & Dionne

[57] ABSTRACT

A shaft furnace plugging apparatus is presented which occupies very little space and sweeps out a relatively low and comparatively flat continuous trajectory between an inoperative position and an operative position. The plugging apparatus includes a clay gun pivotably mounted on a first end of a jib, the jib being rotatable about a support column. The apparatus also includes a pair of hydraulic cylinders, the first hydraulic cylinder being pivotably attached between a second end of the jib and an intermediate pivotable frame and the second hydraulic cylinder which is operative between the intermediate pivotable frame and a fixed support frame.

14 Claims, 8 Drawing Figures

TAPHOLE PLUGGING APPARATUS FOR A SHAFT FURNACE

BACKGROUND OF THE INVENTION

This invention relates to a plugging device for a shaft furnace. More particularly, this invention relates to a compact plugging device for a shaft furnace having a wide pivoting angle. The plugging device of the present invention comprises a clay gun mounted on a jib and pivotable via a pair of hydraulic cylinders about a support column, such that when pivoted from an idle position to an operative position, a relatively low and comparatively flat continuous trajectory is swept out.

In a typical prior art plugging device, the means provided for pivoting the jib usually consists of hydraulic cylinders. These cylinders act to pivot a clay gun in accordance with the desired pivoting angle via a two part pivoting movement.

In the case where the desired pivoting angle does not exceed 120° (or 130° at the most), the hydraulic cylinder usually acts between a fixed point and a fulcrum on an arm or jib. While in theory, this above described structure would enable a pivoting angle to be reached of 180°, in practice, the mouth of the clay gun does not develop a sufficient contact pressure upon reaching the tap hole to be plugged. Therefore, in such a structure, the pivoting angle is usually limited to ±90°. The above system offers the advantage of simple construction, however, the relatively small pivoting angle (±90 degrees) prevents the clay gun from being withdrawn a desirable distance from the zone of the tap spout (in view of the high temperatures prevailing during the tapping the operation). Moreover, this system also creates a danger that the clay gun will constitute an encumbrance in its inoperative or idle position.

If a greater pivoting angle then as hereinabove described is required, a lever system may be provided, between a fixed point and a fulcrum on the jib, wherein a hydraulic cylinder will act to sweep out a wider i.e, larger, pivoting angle. This system permits pivoting angles of 180° or more to be obtained, which are accompanied by a contact pressure between the mouth of the clay gun and the tap hole which is sufficiently great so as to properly function.

Typical embodiments of the two systems of shaft furnace plugging device, as described above are disclosed in German Pat. No. 21 57 712, corresponding to U.S. Pat No. 3,765,663, assigned to the assignee hereof, all of the contents of which are incorporated herein by reference.

While the shaft furnace plugging devices described in the above patent, are suitable for their intended purposes, there are nevertheless certain applications wherein the space occupied by the plugging device must be further reduced. In particular, there are certain circumstances wherein it has been found desirable to provide as much free space as possible between the pivotal drive of the clay gun and the shaft furnace. Alternatively, in other cases, it has been found desirable to provide a compact construction for the pivotal drive, so that it can be positioned closer to the shaft furnace during operation.

SUMMARY OF THE INVENTION

The above discussed and other problems of the prior art are overcome or alleviated by the shaft furnace plugging device of the present invention. In accordance with the present invention, a plugging device for shaft furnaces of the type hereinabove discussed, is presented. The compact shaft furnace plugging device of the present invention occupies very little space and necessitates only a moderate amount of mechanical energy input, but nevertheless permits a pivoting angle of over 180° to be obtained by the jib.

In accordance with the present invention, a compact apparatus for plugging the tap hole of a shaft furnace comprises in part, a clay gun pivotably mounted on a first end of a jib and rotatable about a support column, such that when pivoted from an inoperative position into an operative position, a continuous trajectory is swept out wherein the main portion is low and comparatively flat relative to prior art plugging devices. The present invention also includes a first hydraulic cylinder which is operative between a second end of the jib and an intermediate frame and which pivots about the support column. A second hydraulic cylinder is also provided, which is pivotably operative between intermediate pivotable frame and the afixed support frame.

The above-discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in several FIGURES.

Description of the Preferred Embodiment

Figure 1:
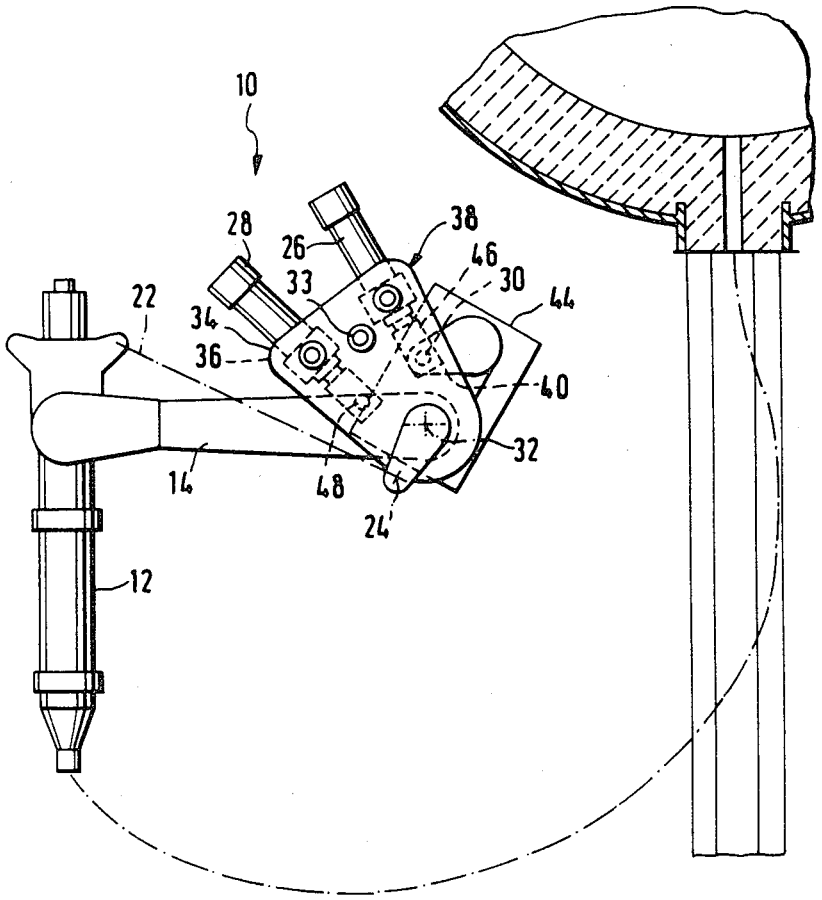
FIG. 1 is a side elevation view, partly in cross-section, of the blast furnace tap hole zone with a tap hole plugging device having two hydraulic cylinders for pivoting the jib of a clay gun in accordance with the present invention.
Figure 2:
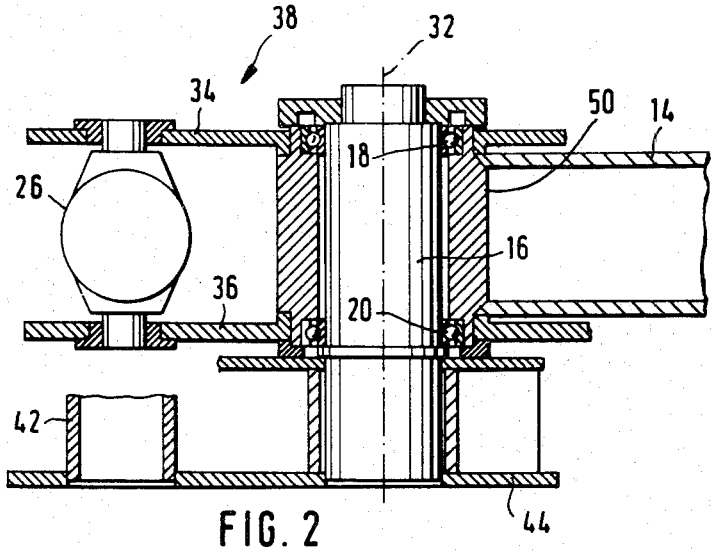
FIG. 2 is an enlarged cross-sectional elevation view through a portion of FIG. 1.

Referring first to FIGS. 1 and 2, a tap hole plugging device for shaft furnaces is shown generally at 10. Tap hole plugging device 10 includes a clay gun 12 pivotably mounted on a jib 14. The pivotable jib 14 is rotatably mounted, by means of, for example, a roller bearing system 18 and 20, on a support column 16. Roller bearing system 18 and 20 is preferably inclined at an angle relative to the vertical. A guide bar 22 indicated by a dot-and-dash line is pivotably attached at one end to the clay gun 12 and at the other end to a fixed point 24 on jib 14. Guide bar 22 ensures that clay gun 12 will form a preferred angle with the jib 14, particularly at the two end positions, i.e, between an operative and non-operative position. It should be understood that the particular kinematics of this arrangement of jib 14 and guide bar 22 relative to each other is shown and described in the aforementioned German Pat. No. 21 57 712 (U.S. Pat. No. 3,765,663).

Figure 3:
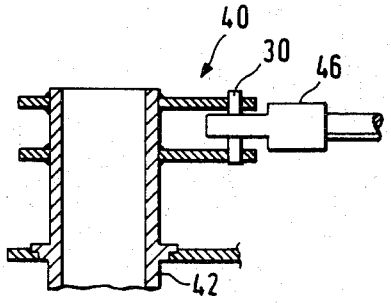
FIG. 3 is an enlarged cross-sectional elevation view through another portion of FIG. 1.

An important feature of the present invention is the presence of two substantially identical hydraulic cylinders 26 and 28 which together provide a novel means of pivoting or rotating jib 14. The first hydraulic cylinder 26 operates and is pivotably connected between a fixed point 30 and frame 38, fixed point 30 being located on a fixed or stationary common support frame 44. Frame 38 consists of two parallel steel or other metal plates 34 and 36 disposed and pivotable about shaft 32 of support column 16. (See FIG. 2) Fixed point 30 is the end point of a forked or double arm 40 (see FIG. 3). Double arm 40 extends between two steel plates 34 and 36 and is attached to a column 42. In turn, column 42 is secured to common fixed support frame 44, thus, providing support for the support columns 16 and 42. It will be appreciated that FIG. 3 is intended to show that portion of FIG. 2 which is positioned behind hydraulic cylinder 26. Note, however, that the end 46 of cylinder rod 26 has been rotated an angle of 90° about the fixed point 30.

The second hydraulic cylinder 28 is pivotably connected between frame 38 and a fulcrum 48 on jib 14. Note that hydraulic cylinder 28 is positioned between the two parallel plates 34 and 36 of frame 38 in a manner similar to the positioning of hydraulic cylinder 26.

Accordingly, as a result of the above novel structural arrangement of the two cylinders 26 and 28, by actuating or operating the first cylinder 26 and frame 38, the second cylinder 28 and jib 14 (having the clay gun thereon) will be pivoted through a first angle. Thereafter, by actuating or operating the second cylinder 28, jib 14 (having the clay gun 12 thereon) will be pivoted through a second angle relative to frame 38. Frame 38 thus functions as an intermediate frame and will therefore be termed the intermediate frame 38 hereinafter.

Figure 4:
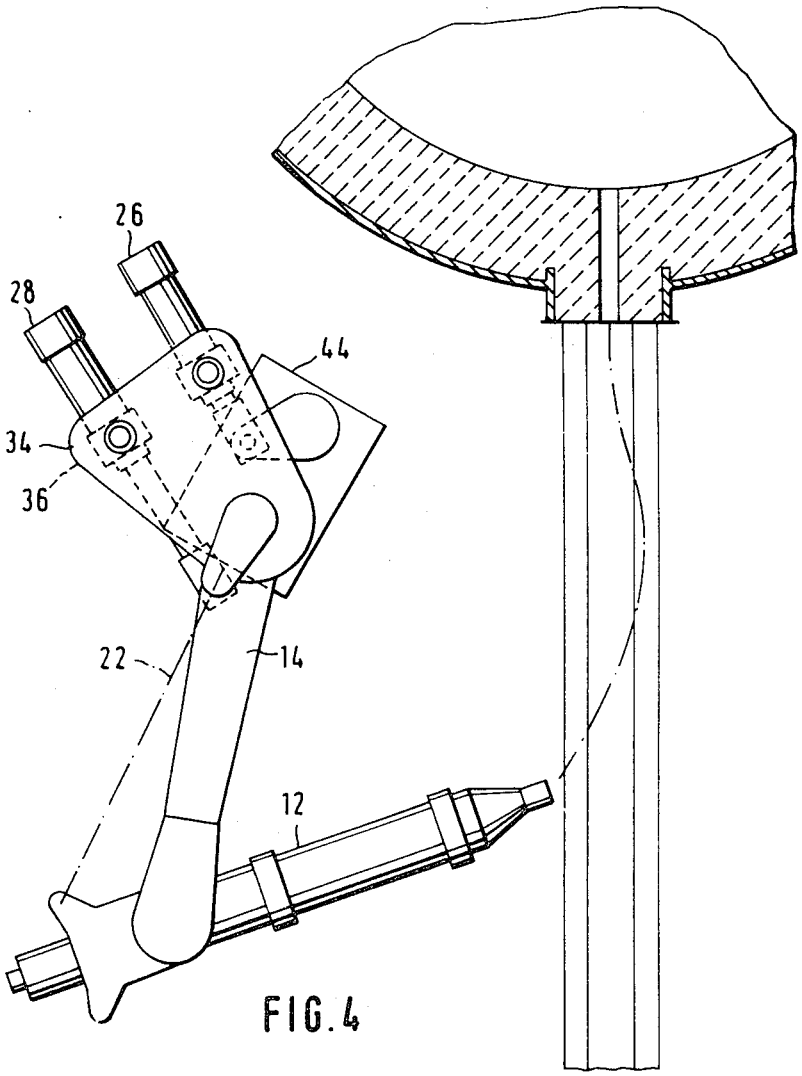
FIG. 4 is a side elevation view, similar to FIG. 1, but showing the first of the two hydraulic cylinders in its extended position.
Figure 5:
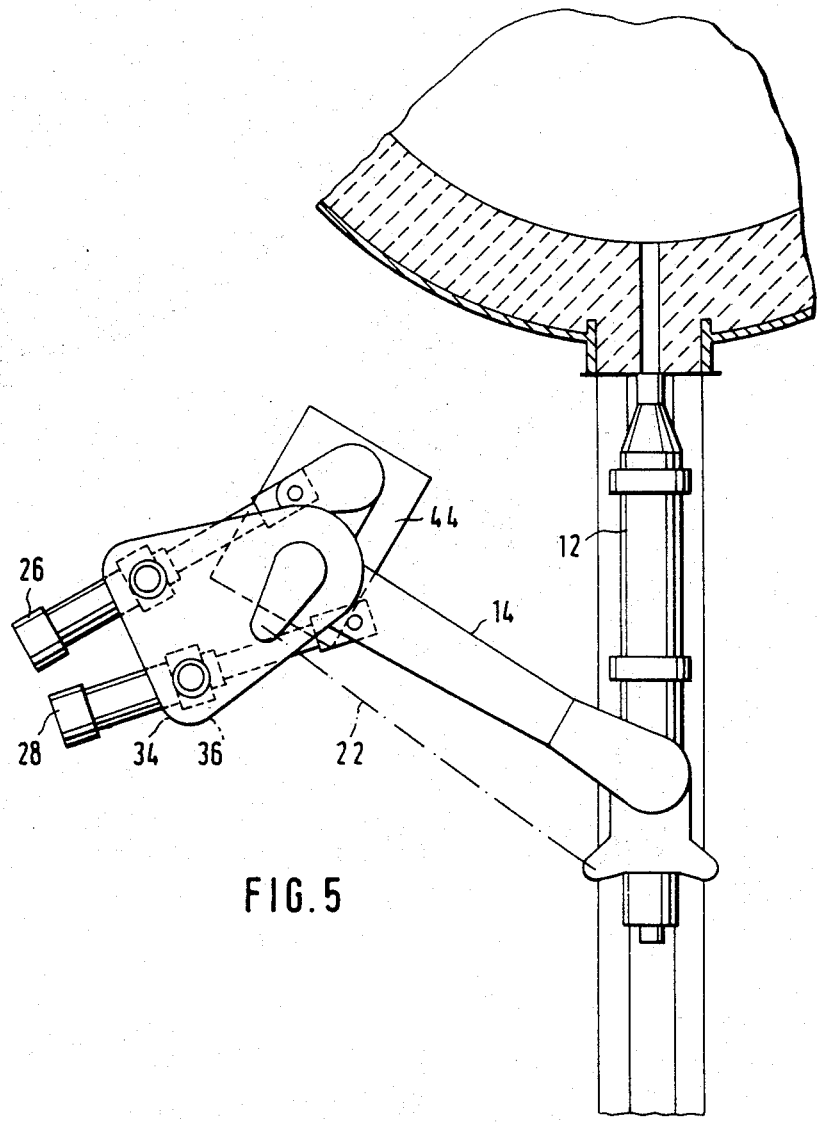
FIG. 5 is a side elevation view, similar to FIG. 4, but showing the second of the two hydraulic cylinders in its extended position.

Referring now to FIG. 4, the piston rod of the second cylinder 28 has been extended such that jib 14 having clay gun 12 thereon is positioned as shown. Thereafter, with reference to FIG. 5, the first cylinder 26 is actuated resulting in the clay gun operating position shown therein. During this actuation process, clay gun 12 has moved from an inoperative position to an operative position, and has swept out the trajectory shown on the dot-and dash lines in FIG. 1. It will be appreciated that the main portion of this trajectory is relatively low down and flat as compared to prior art plugging devices. This particular and preferable trajectory is provided by the novel structure of the present invention and over comes many of the problems discussed earlier. Accordingly, the compact shaft furnace plugging device of the present invention occupies very little space and necessitates only a moderate amount of mechanical energy input, but nevertheless permits a pivoting angle of over 180° to be obtained by the jib 14.

It will be appreciated that it is immaterial whether the two cylinders 26, 28 are simultaneously moved in or out or are moved in succession to each other, since in both cases, clay gun 12 will occupy the same end position. Preferably however, the two cylinders are subjected to hydraulic pressure simultaneously i.e., in parallel with each other, so that the use of the hydraulic control apparatus will be kept to a minimum. If, for some reason, cylinders 26, 28 must operate in a selected sequence, this may be easily achieved by a variety of means such as for example, the use of different bearing friction resistance values for which the respective cylinders must overcome during the pivoting movement. In FIG. 2, for example, jib 14 is mounted on support column 16 by roller bearing system 18 and 20 and rotary sleeve 50. It will be understood that the bearing system between sleeve 50 and intermediate frame 38 is a plan sleeve bearing system. It should also be understood that the mounting system between the intermediate frame 30 and sleeve 50 may take the form of a roller bearing system. In this particular example, the bearing friction resistance is approximately the same for both cylinders 26 and 28. If, however, the cylinders 26, 28 are required to operate in a certain selected sequence as discussed above, then a throttle may be provided to the feed pipe of the last cylinder when it is moved into its extended position. By adoption of the above discussed measures, it is therefore possible to obtain any desired sequence of operating the cylinders. Note that since cylinders 26, 28 are substantially identical, costs are kept down while storage of spare cylinders is substantially simplified.

Figure 6:
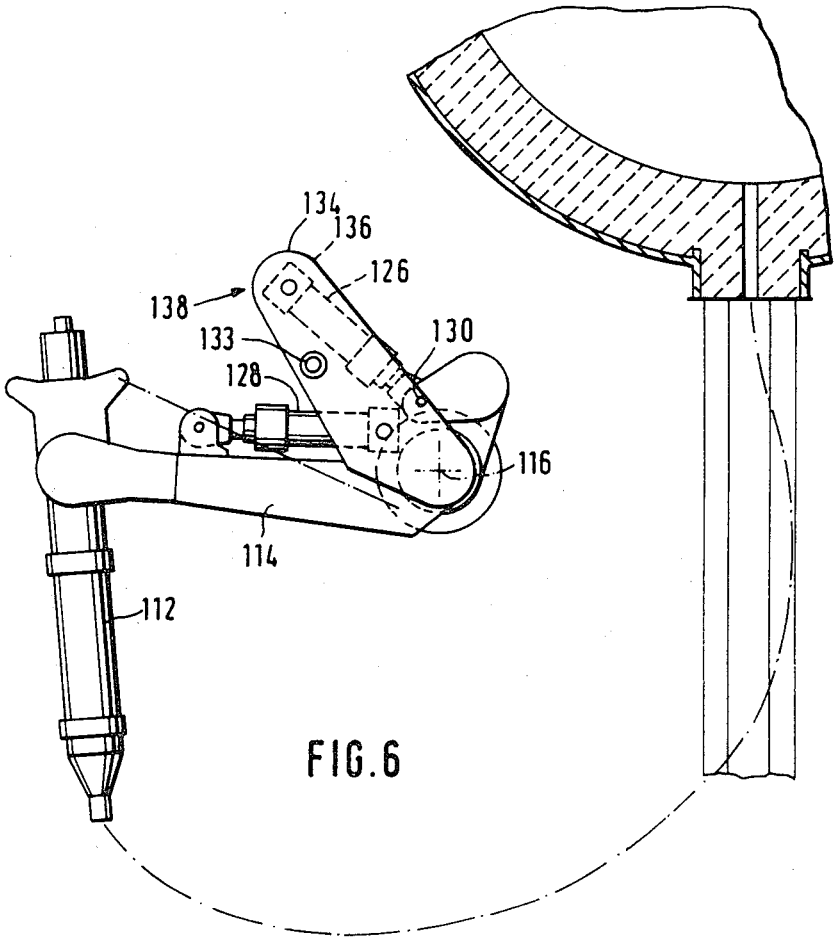
FIG. 6 is a side elevation view, similar to FIG. 1, of an alternative embodiment in accordance with the present invention.
Figure 7:
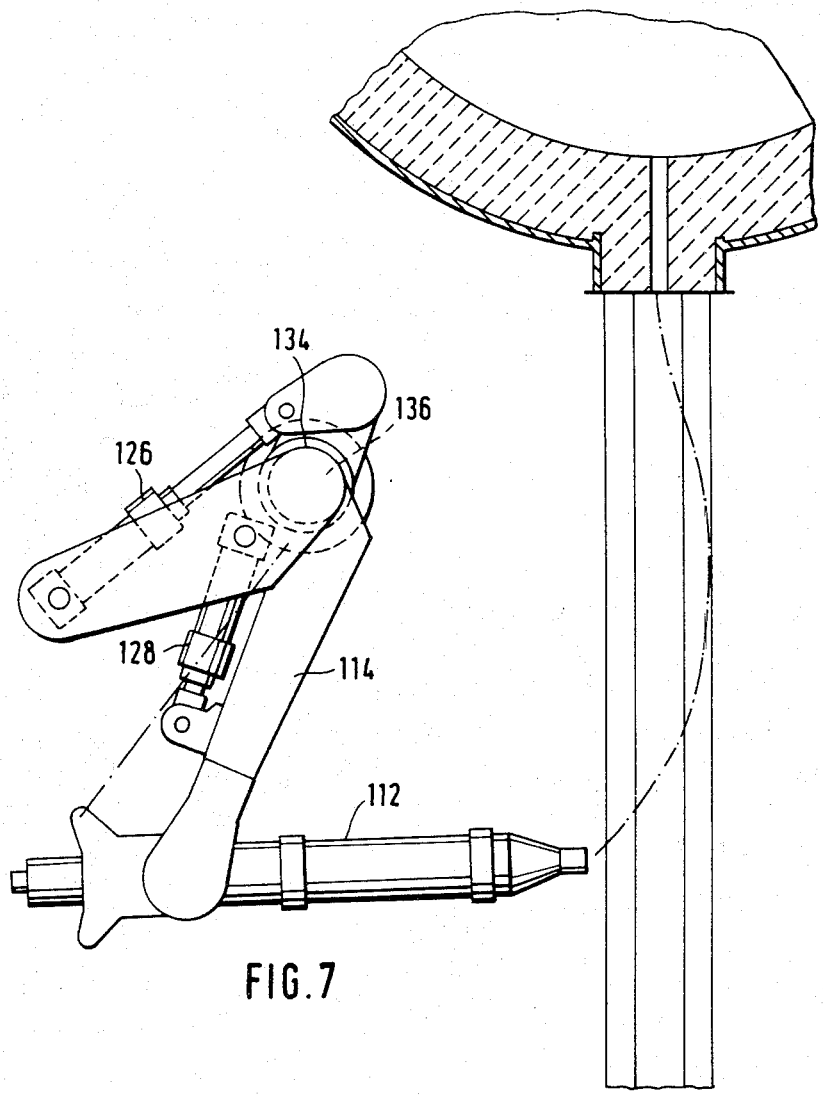
FIG. 7 is a side elevation view, partly in cross section, similar to FIG. 6, but showing the first of the two cylinders in its extended position.
Figure 8:
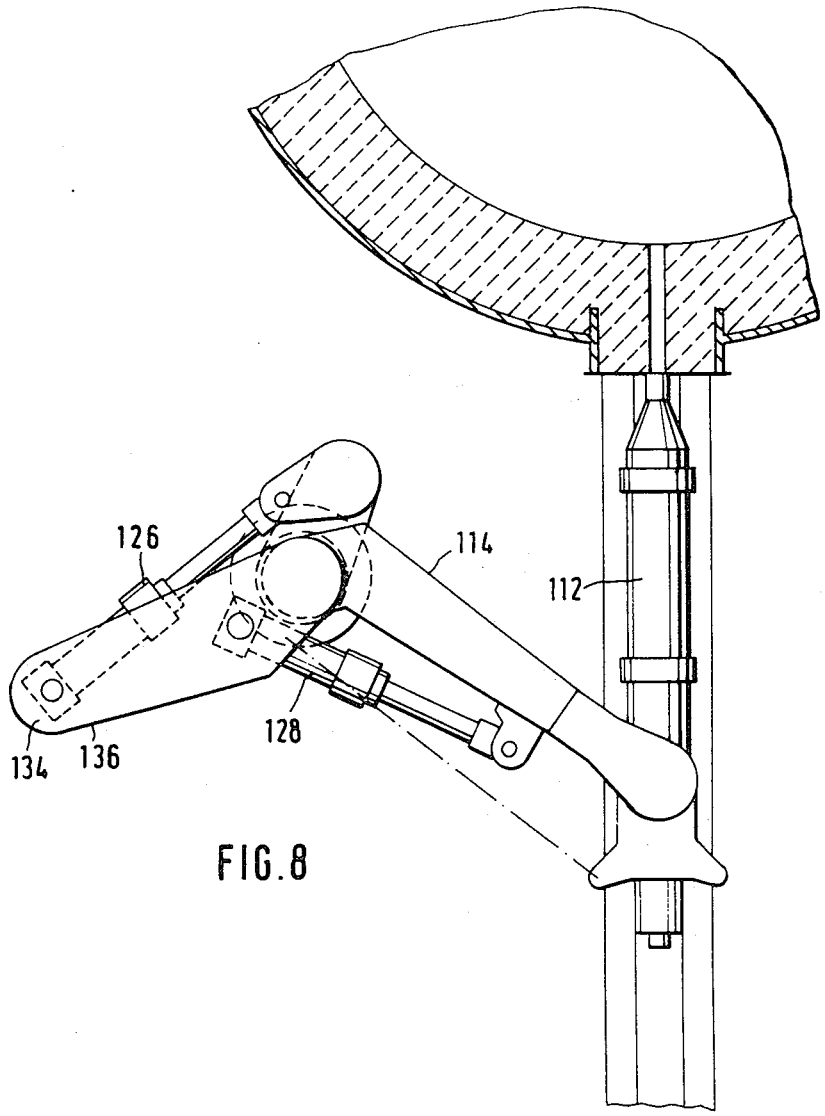
FIG. 8 is a side elevation view similar to FIG. 7, but showing the second of the two cylinders in its extended position.

Referring now to FIGS. 6, 7 and 8, an alternative embodiment of the shaft furnace plugging device of the present invention is shown. As in the first embodiment, the second embodiment includes preferably identical hydraulic cylinders 126, 128 pivotably attached to an intermediate frame 138. Also, as in the first embodiment, the first hydraulic cylinder 126 operates and is pivotably connected between a fixed point 130 (fixed point 130 being positioned on a fixed support frame) and an intermediate frame 138, while a second hydraulic cylinder 128 operates between the intermediate frame 138 and jib 114. The primary difference between the second embodiment and the first embodiment is that the first hydraulic cylinder 126 is positioned approximately parallel to the elongated configuration of the intermediate frame 138 while the second hydraulic cylinder 128 is approximately parallel to the jib 114. In contrast, in the first embodiment illustrated in FIGS. 1–5, hydraulic cylinders 26 and 28 and intermediate frame 36 are actually symmetrical to one another, i.e., cylinders 26 and 28 are symmetrical about the axis of symmetry 31 (see FIG. 1) of intermediate frame 38.

The method of operating the embodiment shown in FIGS. 6–8 is substantially the same as in the first embodiment. Thus, cylinders 26 and 28 are subjected to pressurized fluid (preferably simultaneously) wherein the pistons move in and out either simultaneously or, as described above, in a selected sequence. FIG. 7 for example, shows the position occupied by clay gun 112 after the first hydraulic cylinder 126 has been actuated and moved outwardly. Similarly, FIG. 8 shows clay gun 112 in an operative position after the extension of both hydraulic cylinders 126 and 128.

A significant feature of the second embodiment is the relatively small amount of space required for a 180° pivotable trajectory. It will be appreciated that while the FIGURES indicate a pivoting angle of about 150° (comparing FIG. 1 to FIG. 5) which has been found sufficient, this angle may be increased if desired to 180° or more.

The two plates 34 and 36 (134 and 136) are rigidly interconnected by any suitable means. For example, plates 34 and 36 maybe interconnected by spacers secured by screws or the like as shown at 33 in FIG. 1.

As discussed earlier, support column 16 shown in FIG. 2 is preferably inclined relative to the vertical.

Further details of the features and advantages of this support system and also of an advantageous method of suspending clay gun 12 and jib 14 are described in German Pat. No. 28 40 181.

While preferred upon embodiments have been shown and described, various modifications and substitutions may be made thereto with departing from the spirit and scope of the invention. Accordingly, it is to be understood that the present invention has been described by way of illustrations and not limitations.

What is claimed is:

1. An apparatus for plugging the taphole of a shaft furnace comprising:

jib means, said jib means being rotably mounted about a first support column;

clay gun means, said clay gun means pivotably mounted on a first end of said jib;

pivotable frame means, said frame means being attached to a second end of said jib and being pivotable about said first support column;

first hydraulic cylinder means being pivotably attached between a second end of said jib means and said pivotable frame means;

a second support column;

fixed support frame means, said first and second support columns being attached to said fixed support frame means;

second hydraulic cylinder means being pivotably attached between said pivotably frame means and said fixed support frame means wherein said first and second hydraulic cylinder means may be actuated between and operative and an inoperative position and wherein said clay gun means sweeps out a trajectory, a portion of said trajectory being substantially low down and flat.

2. The apparatus of claim 1 wherein said pivotable frame means comprises:

two substantially parallel spaced plates wherein said first and second cylinder means are pivotably attached between said spaced parallel plates.

3. The apparatus of claim 1 wherein:

said jib means is rotatably mounted to said first support column via a rotary sleeve, and including roller bearing means positioned between said sleeve and said first support column.

4. The apparatus of claim 3 wherein:

said pivotable frame means is pivotably mounted to said rotary sleeve.

5. The apparatus of claim 2 wherein:

said jib means is rotatably mounted to said first support column via a rotary sleeve, and including roller bearing means positioned between said sleeve and said first support column.

6. The apparatus of claim 5 wherein:

said pivotable frame means is pivotably mounted to said rotary sleeve.

7. The apparatus of claim 1 wherein:

said pivotable frame means includes an axis of symmetry and wherein said first and second cylinder means are symmetrically positioned about either side of said axis.

8. The apparatus of claim 2 wherein:

said pivotable frame means includes an axis of symmetry and wherein said first and second cylinder means are symmetrically positioned about either side of said axis.

9. The apparatus of claim 1 wherein:

said first cylinder means is substantially parallel to said pivotable frame means; and said second cylinder means is substantially parallel to said jib means.

10. The apparatus of claim 2 wherein:

said first cylinder means is substantially parallel to said pivotable frame means; and said second cylinder means is substantially parallel to said jib means.

11. The apparatus of claim 1 including:

a forked arm attached to said second support column, said second hydraulic cylinder means being pivotably attached to said forked arm.

12. The apparatus of claim 2 including:

a forked arm attached to said second support column, said second hydraulic cylinder means being pivotably attached to said forked arm.

13. The apparatus of claim 1 including:

guide bar means pivotably attached between said clay gun means and said jib means.

14. The apparatus of claim 2 including:

guide bar means pivotably attached between said clay gun means and said jib means.

* * * * *